US005699039A

United States Patent [19]

Korzen

[11] Patent Number: 5,699,039

[45] Date of Patent: Dec. 16, 1997

[54] ELECTRONIC TABLE PAGER AND DISPLAY DEVICE

[76] Inventor: Victor Korzen, 410 S. Warren Ave., Palatine, Ill. 60067

[21] Appl. No.: 647,849

[22] Filed: May 15, 1996

[51] Int. Cl.[6] ..... G08B 23/00

[52] U.S. Cl. ..... 340/311.1; 340/286.09; 340/331; 340/332; 340/321

[58] Field of Search ..... 340/321, 331, 340/332, 286.09, 311.1; 362/157, 841; 40/124.1, 542, 544

[56] References Cited

U.S. PATENT DOCUMENTS

| | | | |
|---|---|---|---|
| 2,638,583 | 5/1953 | Edwards, Jr. | 340/321 |
| 3,967,274 | 6/1976 | Howell | 340/321 |
| 4,250,491 | 2/1981 | Dotson | 340/321 |
| 5,489,887 | 2/1996 | Porras | 340/332 |

*Primary Examiner*—Jeffery Hofsass
*Assistant Examiner*—Julie B. Lieu
*Attorney, Agent, or Firm*—Dorn, McEachran, Jambor & Keating

[57] ABSTRACT

A menu stand or like device is employed as a signal device to summon a waiter to a table in a restaurant or like establishment. The device includes a housing having a base that supports it on a table and a low-energy demand light source. The light source is preferably a thin electroluminescent (EL) surface element mounted on a menu holder that is a part of the housing. A D.C. battery, removably mounted in the housing base, energizes an inverter that generates an A.C. energizing signal that is applied to the light source. Preferably, the A.C. energizing signal pulsates at a low frequency. There is a switch, normally open, that turns the light source ON to summon a waiter.

6 Claims, 1 Drawing Sheet

FIG. 1
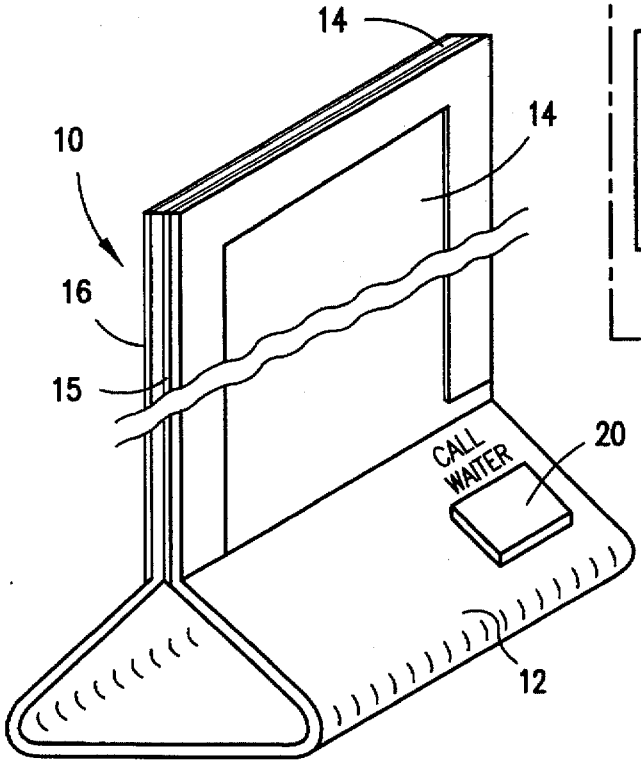
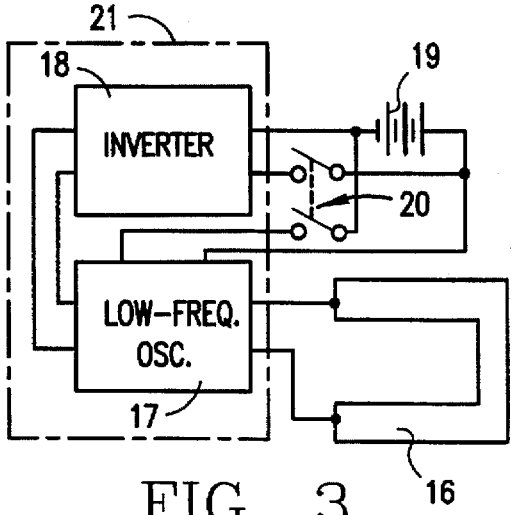
FIG. 3
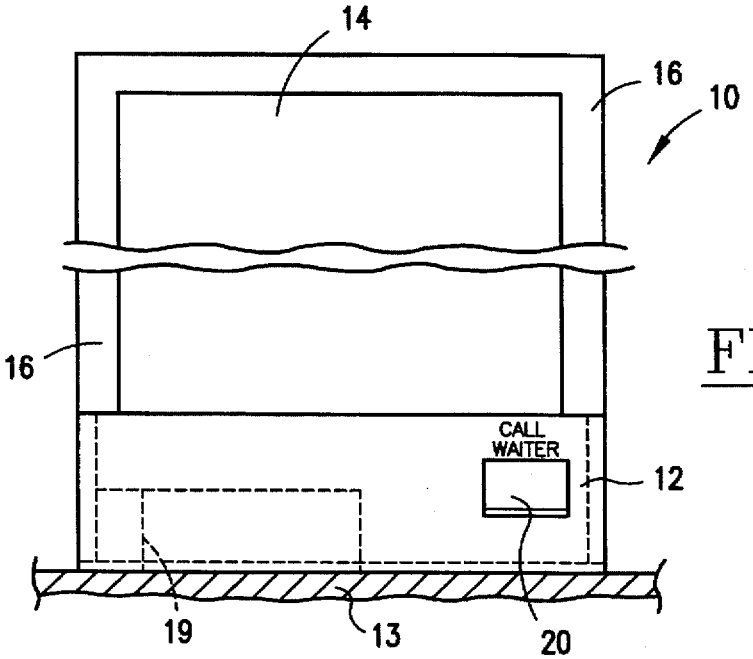
FIG. 2

ELECTRONIC TABLE PAGER AND DISPLAY DEVICE

BACKGROUND OF THE INVENTION

When a restaurant patron wants to place an order or to obtain a check, attention of the waiter is often difficult to attract. The result is often frustration for the patron and sometimes a loss of business for the waiter and/or the restaurant.

Radio signal systems have been proposed to summon a restaurant waiter to a particular table. In general, those systems have been unduly expensive and sometimes unreliable. Prior systems have also had a disadvantage in that they may require a broad range of radio-frequency signals, with a separate signal for each table in the restaurant. If the radio-frequency signals are too strong, conflict with governmental requirements may occur; if those signals are too weak, the attention of the waiter may not be attracted.

STATEMENT OF THE INVENTION

It is an object of the invention, therefore, to provide a new and improved signal device that does not use radio-frequency signalling to attract the attention of a waiter to a given table and that can serve a useful purpose even when unactuated.

Another object of the invention is to provide a new and improved table pager and display device that is simple and economical in construction, has a long operating life, and is readily operated by an untutored restaurant patron.

Accordingly, the invention relates to a signal device for summoning a waiter to a table. The signal device, usually a part of a menu stand, includes a housing having an integral base to support the housing on a table. A low-energy-demand high-voltage A.C. energized light source, preferably an electroluminescent (EL) light source, is mounted on the housing, and a D.C. battery is removably mounted in the housing, usually in its base. An inverter, mounted in the housing, generates an A.C. output signal from a low-voltage D.C. input. An energizing circuit, in the housing, connects the battery to the inverter and connects the inverter to the light source. There are switch means, connected in the energizing circuit, for selectively energizing and de-energizing the light source with the A.C. output signal of the inverter to summon a waiter, visually, to the table.

BRIEF DESCRIPTION OF THE DRAWINGS

FIG. 1 is a perspective view of a signal device constructed in accordance with a preferred embodiment of the invention;

FIG. 2 is a side elevation view of the signal device of FIG. 1; and

FIG. 3 is a simplified block diagram, partly schematic, of an electrical circuit for the signal device of FIGS. 1 and 2.

DESCRIPTION OF A PREFERRED EMBODIMENT

FIGS. 1 and 2 illustrate a signal device 10 that is structurally similar to the conventional menu stand or advertising stand present on many tables in restaurants and like establishments. Signal device 10, however, has been modified to adapt it to use in summoning a waiter to the table. The reasons for summoning a waiter are legion; typically, signal device 10 may be employed to bring a waiter to the table to take an order, to respond to some complaint of a restaurant patron at the table, or to present a check.

Signal device 10 includes a housing having a base 12 that supports the device on the top surface 13 of a restaurant table (FIG. 2). The housing of device 10 further includes two flat, transparent, vertical display support members 14 that project upwardly from base 12. A menu or advertising card 15 may be disposed between and supported by members 14, as shown in FIG. 1.

Signal device 10, FIGS. 1 and 2, includes a light source 16. Light source 16 is not an ordinary incandescent lamp; it is preferably a low energy-demand light source energized by an A.C. signal, preferably a high-voltage A.C. signal. A thin, surface mounted electroluminescent (EL) light source of the kind available commercially under the designation is acceptable. A miniature neon lamp could also be used. An electroluminescent (EL) light source produces a light output readily discernible by human eyes when excited by a suitable A.C. signal. The color and the intensity of the preferred EL light source is determined by the amplitude and frequency of the applied signal. When not excited, the light output of source 16 is effectively zero. In the form of signal device 10 shown in FIGS. 1 and 2, the light source 16 is mounted on and extends around the sides and top of the two vertical display support members, having an inverted "U" shape on each support member. However, the light source could also extend across the bottom of each support 14. Indeed, an electroluminescent (EL) light source mounted on only one side of signal device 10 may often be adequate, and the shape or pattern (U,□, L, etc.) of the light source is not critical. A miniature neon light source may also be used.

Energization of the light source 16 is best effected by one or more D.C. batteries; the batteries are preferably mounted within base 12. A simplified circuit for this purpose is shown in FIG. 3. In that arrangement the light source 16 is connected to an oscillator 17. The oscillator 17 is also connected to the output of an inverter 18. The oscillator 17 and the inverter 18 are both energized from a low-voltage D.C. battery 19. The energizing circuit that connects battery 19 to inverter 18 and oscillator 17 includes a switch 20 to disable the operating circuit for light source 16. When switch 20 is open, as shown, light source 16 is not energized and there is no current drain for battery 19. This simple expedient greatly extends the working life of the battery. That is, battery 19 is normally open-circuited at switch 20.

Switch 20 is mounted on base 12 of device 10, as shown in FIGS. 1 and 2, readily accessible to a patron using the restaurant table 13. Switch 20 should also be readily accessible to a waiter, though this is not critical because the waiter can request the patron to actuate the switch.

The operation of signal device 10 is quite simple; the restaurant patron at table 13 needs no instruction in its use. When a patron at a table equipped with device 10 wants to summon a waiter, that patron actuates switch 20, shown in FIG. 1 as a simple membrane switch, to complete the operating circuit between inverter 18; see FIG. 3. Inverter 18 generates an A.C. output signal that is modulated by the low-frequency oscillator 17, so that light source 16 is energized and emits light pulses to attract and summon a waiter to the table to attend to the patron as desired. Inverter 18 and oscillator 17 can be combined in a single circuit unit 21; a modulator circuit may also be included. All of the circuit components of FIG. 3 are commonly available and are easily mounted in base 12 of the housing of device 10. The restaurant patron and the waiter (or bus boy) need not know how device 10 is constructed and operates. Indeed, the only service that the signal device 10 normally requires is replacement of the battery or batteries 19 when they have run down. Pulsating energization of light source 16 is usually quite useful; a steady output (glow) from the light source might be overlooked by the waiter and hence could be ineffectual.

I claim:

1. A signal device for generating an intermittent A.C. light signal summoning a waiter to a table, the signal device comprising:

a signal device housing including an integral base to support the housing on a table;

a high voltage low-energy-demand electrically energized A.C. light source mounted on the housing;

a D.C. battery removably mounted in the housing;

inverter means, mounted in the housing, for generating a high-voltage A.C. output signal from a low-voltage D.C. input;

an energizing circuit, in the housing, connecting the battery to the inverter and connecting the inverter to the light source;

switch means, connected in the energizing circuit, for selectively energizing and de-energizing the light source with the A.C. output signal of the inverter to produce an intermittent light signal to summon a waiter to the table;

wherein the signal device also serves as a display stand for a display card and the housing of the device serves as a support for the display card.

2. A signal device for summoning a waiter to a table, according to claim 1, in which the base encloses a chamber within which the battery is removably mounted and within which the inverter means and the energizing circuit are mounted, and in which the switch means comprises an ON-OFF switch mounted on the base, accessible from the exterior of the base.

3. A signal device for summoning a waiter to a table, according to claim 2, in which the housing, including the base and the display card support, is of unitary, one piece molded plastic construction.

4. A signal device for summoning a waiter to a table, according to claim 3, in which the display card support includes two transparent support members projecting vertically upwardly from the base.

5. A signal device for summoning a waiter to a table, according to claim 1, in which the light source is a thin, elongated, high voltage electroluminescent (EL) altrenating current light source mounted on the display card support.

6. A signal device for summoning a waiter to a table, according to claim 5, in which the signal device further comprises a low frequency oscillator, connected to the inverter means and to the light source, for modulating the output signal at a low frequency.

* * * * *